United States Patent [19]

Hobbs

[11] 4,025,204

[45] May 24, 1977

[54] WRITING IMPLEMENT

[75] Inventor: Gerald E. Hobbs, Fort Madison, Iowa

[73] Assignee: Textron, Inc., Providence, R.I.

[22] Filed: Jan. 16, 1976

[21] Appl. No.: 649,866

[52] U.S. Cl. ..... 401/109

[51] Int. Cl.[2] ..... B43K 24/06

[58] Field of Search ..... 401/110, 116, 75

[56] References Cited

UNITED STATES PATENTS

| | | | |
|---|---|---|---|
| 3,597,100 | 8/1971 | Ganz | 401/116 X |
| 3,630,629 | 12/1971 | DiSpirito | 401/116 |

*Primary Examiner*—Lawrence Charles
*Attorney, Agent, or Firm*—Thomas E. Frantz

[57] ABSTRACT

A writing or marking implement comprising a cartridge unit; a housing for the unit; an operating mechanism including a pair of relatively rotatable driving members supported in axial alignment with the housing, and a follower slidingly engaging the driving members and reciprocating the unit between a concealed position and a point exposed position in response to relative rotation of the driving members; and a coupling providing a releasable threaded connection between the housing and mechanism whereby the mechanism and housing are selectively separable to permit removal or replacement of the unit, the coupling including interengaging wedged surfaces locking the threaded connection against inadvertent loosening under the rotary forces generated during repeated actuations of the mechanism.

14 Claims, 5 Drawing Figures

WRITING IMPLEMENT

BACKGROUND OF THE INVENTION

1. FIELD OF THE INVENTION

The present invention relates generally to hand held instruments and more particularly to a writing, marking or similar implement in which a replaceable unit is reciprocated between a concealed position and a point exposed position in response to relative rotation of two sections of the implement housing.

2. DESCRIPTION OF THE PRIOR ART

The prior art is replete with proposals for instruments of the type having a manually operated mechanism for reciprocating a writing or marking unit between a concealed position and a point exposed position. These proposals can be catagorized generally into two basic groups. One group includes a push button or similar exposed element adapted to be pressed by the user to actuate the mechanism and move the unit. In the other group, the instrument holder includes a pair of coaxially aligned sections which are rotated relative to one another to actuate the mechanism and reciprocate the unit.

One of the features or advantages or the usual push button type instrument is the ease and convenience with which the cap and barrel are disassembled for removal or replacement of a spent or damaged unit. Almost without exception, in this type of instrument, the cap and barrel are coupled by a simple threaded connection adapted to be engaged and disengaged by a universally recognized and easily understood turning action.

In the past, attempts have been made to use the same simple type of threaded connection to releasably couple the cap and barrel of an instrument having a rotating type mechanism. Unfortunately, these attempts have met with little or no success. Repeated actuations of a rotating type mechanism will tend to "unlock" the usual threaded connection even if it initially is tight, thereby resulting in inadvertent loosening of the cap and barrel. Thus, prior to the present invention, the advantages of a simple threaded cap/barrel connection have not been available in instruments having a rotating type mechanism.

One proposal for overcoming this problem of inadvertent loosening is described in U.S. Pat. No. 3,292,592. Essentially the structure suggested in this patent includes a coarse thread for the actuating mechanism and a fine thread for the cap/barrel coupling. The coarse thread is described as having less "lock up" force than the fine thread, whereby the mechanism supposedly will operate with less rotary force than that required to loosen the cap/barrel coupling. However, this patent does not recognize that even if the fine coupling threads are properly locked up, repeated actuations of the mechanism will tend to loosen them, just as repeated taps on a stubborn jar lid will gradually loosen the lid.

As the writing instrument industry has not previously come up with a practical solution to this "loosening" problem, most commercially available rotary mechanism type instruments have utilized various "rear loading" structures, several of which are illustrated in the following representative U.S. Pats. Nos. 2,753,844; 3,436,160; 3,027,873; 3,630,629; 3,289,637.

In this general type of structure, removal of the cap exposes an adapter carried on the rearward end of the writing unit for releasable connection to a reciprocal follower portion of the mechanism. If it is desired to replace the unit, the adapter is unscrewed or detached from the follower and the unit withdrawn therethrough. The new unit is then inserted through the mechanism, and the adapter of the new unit attached to the follower. Reassembly of the cap then completes the unit replacement process.

Such rear loading instruments have had some commercial success, but not without creating additional problems. For instance, it has been necessary to limit their use to the so-called "capillary" type small diameter units which can be assembled through the mechanism. Otherwise, use of a large jumbo type unit would require enlargement of the diameter of the mechanism and holder to the point where the finished instrument would be uncomfortable and unwieldy for most users. Also, since the unit is attached to the mechanism follower, a special threaded adapter must be provided with each unit. This adapter not only increases the ultimate cost of the unit, but prevents its use in other types of instruments. Further, the process of replacing the unit is time consuming and complicated. Yet another problem is the necessity of having a unit of the proper size and with the proper adapter. If such a unit should not be available, other types or brands generally cannot be used. In addition, the usual rear loading type rotating mechanism is complicated and costly to produce and repair.

SUMMARY OF THE INVENTION

Therefore, it is a principal object of this invention to provide an improved writing, marking or similar implement having an operating mechanism of the rotary action type.

Another object of the present invention is the provision of an improved threaded coupling arrangement between the cap and barrel of an implement having an operating mechanism of the rotary action type.

Yet another object of this invention is to provide, in an implement of the type having a rotary operating mechanism, structure for threadedly coupling the cap and barrel and for releasably locking such coupled engagement against the rotary forces generated by repeated actuations of the mechanism.

A still further object of the present invention is the provision of an improved rotary action type implement which is small in diameter but adapted to accept large diameter or jumbo units, which is inexpensively manufactured and which is rugged yet convenient, simple and reliable in use.

These and other objects of the present invention will become apparent from the following description and accompanying drawings.

In essence, this invention contemplates the provision of a writing or marking instrument having an elongate housing provided with axially aligned cap and barrel sections which are rotatable relative to one another to reciprocate a cartridge unit between a concealed position and a point exposed position. Within the cap is an operating mechanism comprising two concentrically disposed driving members which are axially fixed but relatively rotatable in response to rotation between the housing sections, there being a follower operatively engaging the driving members and reciprocating the unit between its concealed and point exposed positions in response to rotation between the driving members. A coupling provides a releasable threaded connection between the barrel and one of the driving members to permit selective separation of the mechanism and housing whereby the unit may be removed or replaced, the coupling including annular surfaces which are wedged together to lock the threaded connection against inadvertent loosening as a result of repeated actuations of the mechanism.

In the preferred embodiment, the coupling includes a connector sleeve fixed within the barrel and provided with an annular collar extending into the cap. The outer periphery of the collar is spaced radially from the proximate interior surface of the housing and is provided with (i) a frusto-conical surface proximate the inner end of the barrel, and (ii) a thread portion extending into the cap. The frusto-conical surface has a relatively small angle of about 3°–70° with respect to the axis of the holder, and in combination with the radially proximate interior wall of the barrel forms a tapered annular recess facing toward the mechanism. Extending from one of the driving members into this annular recess is a tubular connecting member having a thread section and an expandable open inner end. When the implement is assembled for use, the thread section and thread portion are engaged and the expandable open end is wedged on the frusto-conical surface. In effect, this wedged engagement forms a "sliding lock" which prevents inadvertent loosening of the threaded engagement even when subjected to repeated actuations of the mechanism but which can be overcome by manual forced rotation between the connecting member and connecting sleeve should it be desired to separate the mechanism from the barrel for removal or replacement of the unit.

The other or second driving member operatively engages the interior surface of the cap and rotates in response to rotation of the cap. Preferably this operative engagement is of a frictional nature and of a magnitude which will permit manual removal of the cap rearwardly from the second driving member should it be desired to expose the mechanism without separating the mechanism and barrel.

DESCRIPTION OF THE PREFERRED EMBODIMENT

Figure 1:
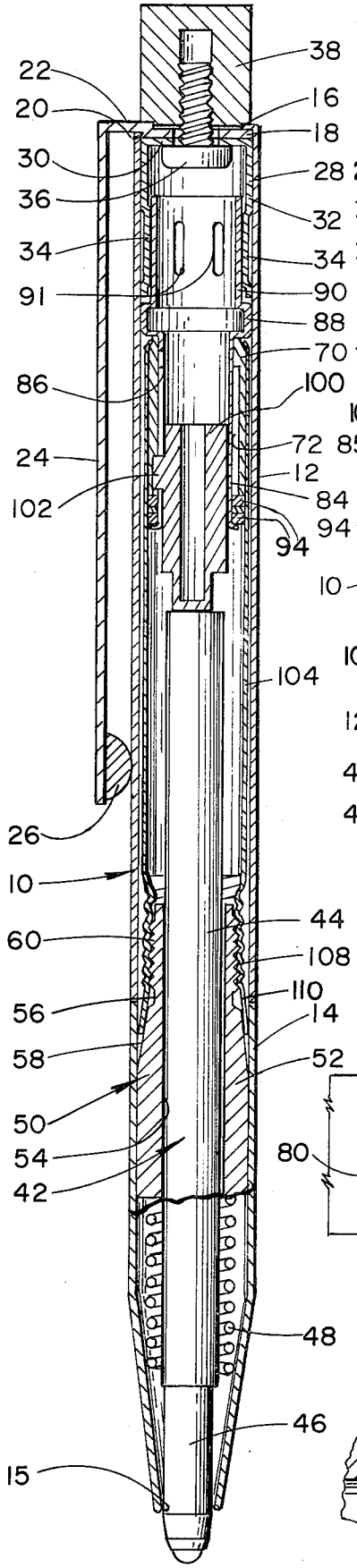
FIG. 1 is a longitudinal sectional view of an implement constructed in accordance with a preferred embodiment of the invention, showing the cartridge unit in an extended point exposed position.
Figure 2:
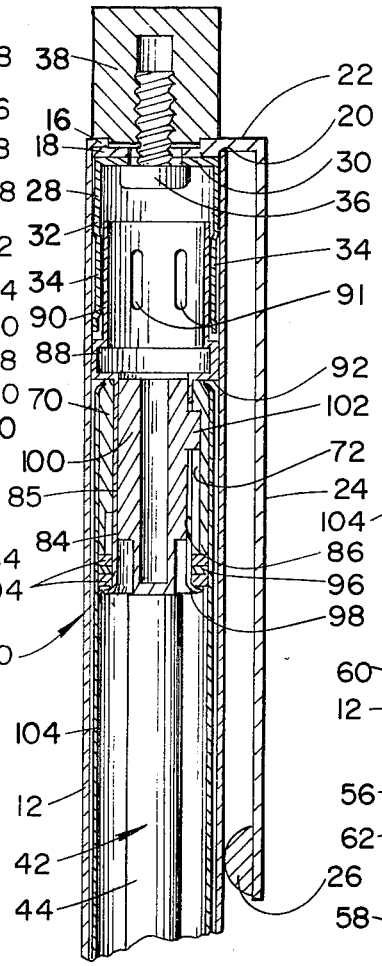
FIG. 2 is a fragmentary, longitudinal sectional view of a portion of the structure of FIG. 1, but showing the unit in a retracted concealed position.

Referring now to the drawings and particularly to FIG. 1, there is illustrated a writing or marking implement having a generally cylindrical housing 10, including a cap section 12 and an axially aligned barrel section 14. The open inner end of cap 12 is of the same diameter as and contiguous with the open inner end of barrel 14, the lower or outer end of which is tapered to form a reduced tip opening 15.

The upper or outer end of cap 12 has an inturned flange 16 adapted to receive an internally disposed clip mount 18. Projecting transversely from the clip mount 18 through an aperture 20 in flange 16 is a support 22 from which depends a resilient clip arm 24 having the usual contact point or ball 26.

Mounted within cap 12 proximate its outer end is a generally cup shaped liner or insert 28. This liner 28 includes a bottom portion 30 abutting clip mount 18, and a tubular wall 32 concentric with and snuggly engaging the interior of cap 12. For a purpose which will be described in greater detail hereinafter, wall 32 is provided with a plurality of longitudinally disposed splines or indents 34.

Liner 28 and clip mount 18 are maintained in position by the head of screw 36, the shank of which extends through aligned apertures in bottom portion 30 and mount 18 for threaded engagement with a decorative knob 38. The inner end of knob 38 is provided with an annular shoulder which abuts the outer surface of flange 16 and which forms a projection of reduced diameter snuggly centered within the flange.

Disposed within the housing 12 is a cartridge unit 42 having an elongate reservoir 44 and an outwardly projecting point 46 of a diameter slightly less than that of the tip opening 15. In this connection, the drawings illustrate the unit 42 as having a ball point type point, but it will be understood that units having other types of points may readily be used in the implement herein described.

A coil spring 48 is disposed in barrel section 14 around the forward portion of unit 42, one end of the spring 48 stopping against the interior of the tapered portion of barrel 14, with the other end engaging an offset or shoulder (not shown) on the unit 42. As will be readily understood, spring 48 normally biases unit 42 inwardly or upwardly toward a position wherein the point 46 is concealed within tip opening 15.

Connector sleeve 50 includes a body portion 52 press fitted or otherwise fixed against displacement in barrel 14, and a central aperture 54 through which the unit 42 is freely movable. Extending upwardly from body 52 and into cap 12 is an annular collar 56, the outer periphery of which is spaced radially from the proximate interior surface of the housing 10 and formed to provide a frusto-conical surface 58 and a thread portion 60. Preferably the thread portion 60 is positioned adjacent the inner end of collar 56 in a spaced relation with surface 58.

Figure 3:
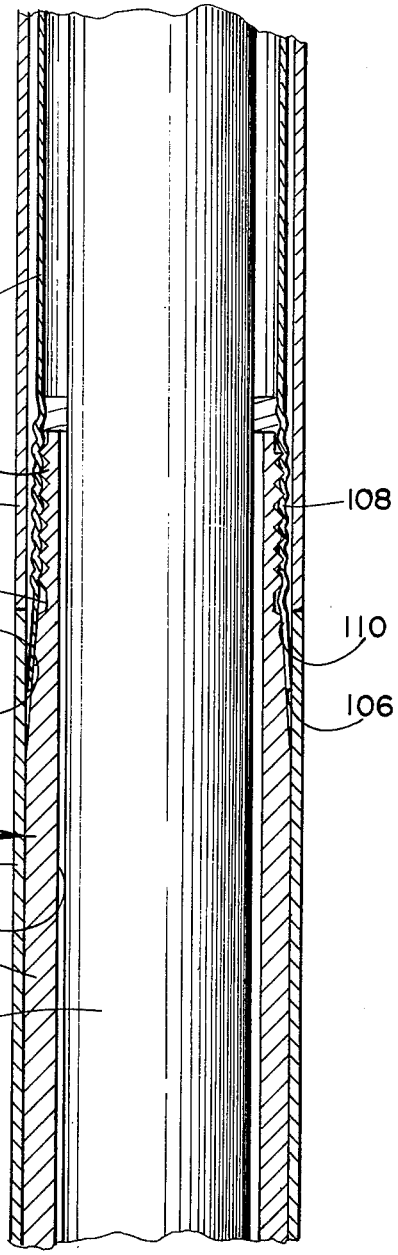
FIG. 3 is an enlarged, fragmentary, longitudinal sectional view of the center section of the structure of FIG. 1, showing in greater detail the coupling between the cap and barrel.

As will be seen readily from FIG. 3, the taper of frusto-conical surface 58 is relatively shallow, preferably being formed at about 5° with respect to the longitudinal axis of the implement. Further, it will be noted that this surface tapers toward and terminates about even with the open inner end of barrel 14. Thus, frusto-conical surface 58 and the radially proximate interior surface of barrel 14 combine to form an annular recess 62 facing toward cap 12.

Figure 4:
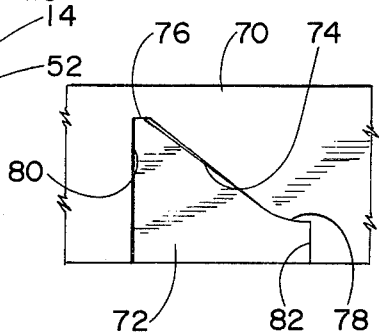
FIG. 4 is a developed view of the interior of one of the driving members of the structure of FIG. 1, showing the cam surface and contiguous offsets provided to reciprocate the unit and maintain the unit in its concealed and point exposed positions.

Located within cap 12 adjacent the rearward end of unit 44 is an operating mechanism for reciprocating the unit between the concealed and point exposed positions described hereinabove. This mechanism includes a pair of axially fixed but relatively rotatable driving members, the first driving member 70 comprising a cylindrical sleeve preferably molded of a wear resistant, self lubricating type of synthetic resin such as nylon or "Delrin". As best shown in FIG. 4, sleeve 70 has a recess 72 formed in its interior wall, the recess opening toward the barrel 14 and defining a cam surface 74 inclined relative to the longitudinal axis of the implement and terminating in transverse offsets 76 and 78 and side walls 80 and 82. The cam surface extends approximately 180° around the interior of sleeve 70.

The second driving member 84 includes a hollow cylindrical portion 85 rotatably received in sleeve 70 and provided with a longitudinally extending slot 86. At the upper or outer end of cylindrical portion 85, there is provided an enlarged section 88 and a slightly reduced cylindrical flange 90 having a plurality of longitudinally disposed splines 91. The outside diameter of flange 90 is slightly greater than the distance between the inside faces of splines 34 of liner 28 thereby providing a relatively tight frictional fit between flange 90 and wall 32 to operatively but releasably connect cap section 12 and second driving member 84. In this connection, even should sufficient rotary force be exerted on cap 12 to cause slippage between flange 90 and wall 32, splines 91 will engage splines 34 to limit such slippage to only a few degrees of rotation. Such splines will not, interfere with manual removal of cap 12 in a rearward direction should exposure of the operating mechanism be desired as, for example, to gain access to an eraser (not shown) which may be carried in the open outer end of flange 90.

Section 88 provides an inwardly facing shoulder 92 adapted to slidably receive the outer end of first driving member 70. Mounted proximate the inner end of cylindrical portion 85 and in sliding engagement with the inner end of first driving member 70 is a thrust assembly consisting of a pair of spaced washers 94 having a spring ring 96 compressed therebetween. This assembly may conveniently be fixed against relative axial movement by outwardly crimping the extreme inner end 98 of cylindrical portion 85. Thus, the washer/-spring assembly, in combination with shoulder 92, will restrain driving members 70 and 84 against relative axial movement while permitting relative rotary movement therebetween. The pressure of this washer/spring assembly creates sufficient "drag" or resistance to movement between the driving members to insure against looseness and inadvertent rotation therebetween as a result of normal handling or use of the implement.

A generally cylindrical follower 100 is slidably housed within second driving member 84. Lug 102 extends from follower 100 through slot 86 in driving member 84 and into recess 72 for engagement with the cam surface 74, transverse offsets 76 and 78 and side walls 80 and 82 in first driving member 70.

As a result of the previously discussed biasing action of spring 48 the outer or rearward end of unit 44 is maintained in abutting engagement with the inner or forward end of follower 100. Thus, reciprocation of follower 100 will cause concomitant reciprocation of unit 44.

The operating mechanisn is releasably coupled to barrel 14 by a tubular connecting member 104 having an outer end telescoped over and rigidly fixed to the first driving member 70, as by being swaged or rolled thereon. Adjacent to but spaced a short distance from the open inner end 106 of connecting member 104 is a rolled thread section 108 releasably engaged with thread portion 60 of sleeve 50.

When thread portion 60 and thread section 108 are fully engaged, open inner end 106 of connecting member 104 forms an annular contact surface disposed in annular recess 62 in tight wedged engagement with frusto-conical surface 58. To even further assure a good wedged engagement, however, it is preferred that at least one axially extending slot 110 be cut through open end 106 and into the first one or two threads of section 108. Thus, as connecting member 104 and connector sleeve 50 are threaded together, open inner end 106 will expand radially over frusto-conical surface 58 until coming in contact with the interior wall of barrel 14. Such contact not only provides a supplemental wedging action but acts to form a stop for limiting longitudinal movement of the connecting member 104 toward the barrel section 14.

As will be apparent from the preceding description, cap section 12 is releasably connected to and rotatable with driving member 84, while barrel section 14 is releasably connected to and rotatable with driving member 70. Thus relative rotation between holder sections 12 and 14 will cause conjoint relative rotation between driving members 70 and 84 to simultaneously reciprocate the follower 100 and unit 44.

Referring particularly to FIG. 4, it will be noted that when the unit 44 is disposed in its concealed position, the lug 102 of follower 100 is positioned in contact with transverse offset 76 and side wall 80. This contact simultaneously limits relative rotary movement of the driving members in one direction and rearward movement of the unit. Upon relative rotation of the driving members in the other direction, the lug 102 is forced forwardly by the combined action of slot 86 and cam surface 74 until it is positioned in contact with transverse offset 78 and side wall 82. This latter contact simultaneously limits rotary movement of the driving members in the other direction while maintaining the unit 44 in its extended position under the influence of writing pressure in point 46.

In prior art devices, such as that illustrated in above discussed U.S. Pat. No. 3,292,592, only a minute amount of rotary movement is required to lose the "locking" effect of the coupled threads. Thus, normal handling and use of such instruments, combined with the "hammer" effect of repeated actuations of the mechanism, wil rapidly tend to loosen the coupling. In an implement constructed according to the present invention, however, the above described wedged engagement is effective to prevent inadvertent loosening of the coupling means (thread portion 60 and thread section 108) over a number of degrees of rotation of the parts. Thus, normal handling and repeated actuations of the mechanism will not cause loosening of the cap and barrel sections.

The unit 44 may, however, be removed and/or replaced easily by first retracting the unit to engage the lug 102 with side wall 80 and then exerting additional rotary force in the same direction until the connecting member has rotated sufficiently to overcome the wedged engagement between open inner end 106 and frusto-conical surface 58. The cap and barrel sections 12 and 14 may then be easily disassembled to permit removal or replacement of the unit 44 through the open inner end of the barrel section 14. Reassembly of the cap and barrel sections is then accomplished by a simple threading action between the sections. In this connection, of course, it will be readily understood that the presence of cap 12 is not required for removal or replacement of the unit 44, since connecting member 104 and the associated mechanism may readily be disassembled from the barrel simply by grasping and rotating the member.

Figure 5:
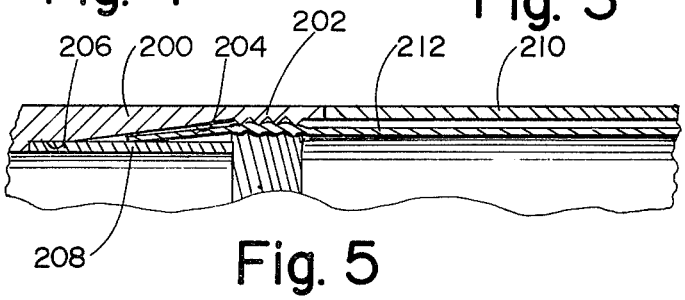
FIG. 5 is an enlarged, fragmentary, longitudinal sectional view of the coupling portion of another embodiment of this invention.

As mentioned heretofore, a large diameter jumbo type unit 44 preferably is used in the present embodiment. However, for any one of several possible reasons it may be desirable to use a smaller diameter capillary type unit. Thus, it will be understood that the present invention is not to be limited to any one size or type of unit. Also, as illustrated by the embodiment of FIG. 5, it will be apparent that various other modifications may be made in the present invention.

In the FIG. 5 embodiment, all parts and components not illustrated or described are substantially equivalent to the comparable parts and components are illustrated in connection with the preferred embodiment.

The barrel section 200 is provided internally of its open inner end with a thread portion 202 terminating in an inwardly tapering or sloping frusto-conical surface 204. Adjacent the base of the frusto-conical surface 204 is an annular recess 206 adapted to frictionally receive a tubular sleeve 208. The tubular sleeve 208 extends toward the open inner end of the barrel 200 and terminates approximately at the end of the thread portion 202 to define with the frusto-conical surface 204 an annular recess opening toward the cap section 210.

Extending inwardly from the actuating mechanism (not shown) is a connecting member 212 which is substantially the same as the above described connecting member 104, except that its contact surface or open inner end is radially restricted by the frusto-conical surface 204 during assembly of the cap and barrel sections 200 and 210.

This invention may be embodied in various other forms without departing from the spirit or essential characteristics thereof. The present embodiments, therefore, are to be considered only as illustrative and not restrictive, with the scope of the invention being indicated by the appended claims rather than by the foregoing description, and all changes which come within the meaning and range of equivalency of the claims are therefore intended to be embraced therein.

I claim:

1. A writing, marking or similar implement, comprising

A. an elongate housing having axially aligned barrel and cap sections mounted for rotation relative to one another about the longitudinal axis of said housing, B. a cartridge unit within said housing, C. a mechanism of reciprocating said cartridge unit relative to said housing between a concealed position and a point exposed position, said mechanism being located within said housing and comprising i. a first driving member rotatable with said barrel, ii. a second driving member rotatable with said cap, iii. said driving members being longitudinally fixed but rotatable relative to one another about the axis of said holder in response to rotation between said barrel and cap sections, and iv. means for reciprocating said cartridge unit between its said concealed and point exposed positions in response to rotation between said driving members, D. means for releasably coupling said mechanism and said housing whereby said housing may be selectively disassembled to permit removal or replacement of said cartridge unit, said coupling means comprising a generally tubular member extending from and threadedly connecting said mechanism to said barrel, and E. means for releasably locking said coupling means against inadvertent disassembly under the rotary forces generated during repeated actuations of said mechanism, said locking means comprising a tapered surface provided by said barrel and telescopically disposed in sliding wedged engagement with said tubular member.

2. An implement according to claim 1 characterized by

A. said tubular connecting member being fixed to said first driving member and provided with a thread section, and B. a connector sleeve carried by said barrel and provided with an annular thread portion releasably engaging said thread section.

3. An implement according to claim 2, characterized by

A. said tapered surface being defined by a frusto-conical surface located within said barrel in a spaced relation with and facing toward said mechanism, and B. an annular contact surface provided by said connecting member and disposed in said sliding wedged engagement with said frusto-conical surface.

4. An implement according to claim 3, characterized by the feature that said connecting member includes an open inner end defining said contact surface.

5. An implement according to claim 4, characterized by said connecting member having an axially extending slot formed in said open inner end, said slot permitting radial deflection of said open end and contact surface in response to said wedged engagement.

6. An implement according to claim 5, characterized by the feature that said frusto-conical surface is positioned to radially restrict said slotted contact surface.

7. An implement according to claim 5, characterized by the feature that said frusto-conical surface is positioned to radially expand said slotted contact surface.

8. An implement according to claim 4, characterized by said connector sleeve being fixed within said barrel and including an annular collar A. extending from within said barrel into said cap, and B. having an outer periphery spaced radially from the proximate interior surfaces of said barrel and cap, said frusto-conical surface and thread portion being formed on said outer periphery.

9. An implement according to claim 8, characterized by the feature that said frusto-conical surface is disposed at an angle between about 3° and about 7° with respect to the longitudinal axis of said sleeve.

10. An implement according to claim 9, characterized by an annular recess A. formed by said frusto-conical surface and the radially proximate interior wall of said barrel, B. opening toward said mechanism, and C. receiving said open inner end of said connecting member, said open inner end being wedged against said interior barrel surface when said contact surface is wedged on said frusto-conical surface.

11. An implement according to claim 10, characterized by the feature that said frusto-conical surface and said thread portion are axially spaced apart on said periphery, said frusto-conical surface being located within said barrel proximate said inner end thereof and said thread portion extending into said cap.

12. An implement according to claim 11, characterized by the feature that said thread section is located on said connecting member in an axially spaced relation with said contact surface, the axial distance between said thread section and said contact surface being less than the axial distance between said thread portion and said frusto-conical surface, wherey during coupling of said connector sleeve and said connecting member said threaded engagement preceeds said wedged engagement.

13. An implement according to claim 12, characterized by

A. said connecting member being fixed to said first driving member,

B. a flange provided by said second driving member and frictionally engaged with the interior of said cap section to operatively connect said second driving member and said cap, and C. means for restraining said cap section and said flange against relative axial rotation while permitting relative longitudinal sliding movement therebetween whereby said cap section may be selectively removed from said housing.

14. An implement according to claim 13, characterized by

A. said first driving member comprising a generally cylindrical sleeve having a recess defining i. a helical cam surface facing toward said barrel, and ii. a transverse offset at each end of said cam surface, B. said other driving member comprising a hollow tubular shell i. rotatably housed within said first driving member, and ii. provided with a longitudinally extending slot, C. a follower longitudinally slidable within said tubular shell and including a lug extending transversely therefrom through said slot and into said recess for engagement with said cam surface and transverse offsets, D. said slot and said cam surface conjointly acting on said lug and reciprocating said follower in response to relative rotary movement between said driving members, E. said lug engaging one of said transverse offsets when said unit is in said point exposed position and restraining said unit and follower against movement toward said concealed position upon the application of pressure to the point of said unit.

* * * * *